US008469731B2

(12) United States Patent
Gloaguen et al.

(10) Patent No.: US 8,469,731 B2
(45) Date of Patent: Jun. 25, 2013

(54) CONNECTOR ASSEMBLY FOR CONNECTION UNDER VOLTAGE

(75) Inventors: Daniel Gloaguen, Le Mans (FR); Pascal Ribeau, Le Mans (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 13/104,519

(22) Filed: May 10, 2011

(65) Prior Publication Data

US 2011/0281448 A1 Nov. 17, 2011

(30) Foreign Application Priority Data

May 11, 2010 (FR) ..... 10 53673

(51) Int. Cl.
*H01R 13/53* (2006.01)

(52) U.S. Cl.
USPC ..... 439/181

(58) Field of Classification Search
USPC ..... 439/181, 843, 839, 851, 852, 878, 439/184, 88, 86, 862
See application file for complete search history.

(56) References Cited

U.S. PATENT DOCUMENTS

| | | | | | |
|---|---|---|---|---|---|
| 4,941,846 | A | * | 7/1990 | Guimond et al. | 439/578 |
| 5,131,858 | A | * | 7/1992 | Heimbrock | 439/181 |
| 5,213,517 | A | * | 5/1993 | Kerek et al. | 439/187 |
| 5,221,220 | A | * | 6/1993 | Roscizewski | 439/843 |
| 5,393,240 | A | * | 2/1995 | Makal et al. | 439/187 |
| 5,480,324 | A | * | 1/1996 | Maegawa et al. | 439/489 |
| 5,525,069 | A | * | 6/1996 | Roscizewski et al. | 439/184 |
| 5,567,170 | A | * | 10/1996 | Kroeber | 439/186 |
| 5,591,039 | A | * | 1/1997 | Matthews | 439/181 |
| 5,655,916 | A | * | 8/1997 | Hayashi | 439/155 |
| 5,676,571 | A | * | 10/1997 | Matthews | 439/843 |
| 6,317,311 | B1 | * | 11/2001 | Middlehurst et al. | 361/637 |
| 6,447,343 | B1 | * | 9/2002 | Zhang et al. | 439/700 |
| 6,478,593 | B2 | * | 11/2002 | Miwa | 439/181 |
| 6,790,101 | B1 | * | 9/2004 | Data et al. | 439/851 |
| 7,670,162 | B2 | * | 3/2010 | Hughes | 439/187 |
| 7,794,252 | B2 | * | 9/2010 | Sauer et al. | 439/186 |
| 7,950,940 | B2 | * | 5/2011 | Hughes | 439/181 |

(Continued)

FOREIGN PATENT DOCUMENTS

| | | | |
|---|---|---|---|
| EP | 1 227 548 | A2 | 7/2002 |
| FR | 2 930 683 | A1 | 10/2009 |
| GB | 2 359 941 | A | 9/2001 |
| WO | 2007/128728 | A1 | 11/2007 |

OTHER PUBLICATIONS

French Search Report, dated Dec. 13, 2010, from corresponding French application.

(Continued)

*Primary Examiner* — Alexander Gilman
(74) *Attorney, Agent, or Firm* — Young & Thompson

(57) ABSTRACT

A connector includes a first connection element (2) provided with a portion of greater diameter (9) upstream to a portion of smaller diameter (10) and a second connection element (3) provided with a female contact element (14, 16) including a local narrowing of diameter (20), the narrowing being upstream to a contact piece (14) housed at the bottom of a cavity. During the connection between the two connection elements, the portion of greater diameter of the male contact element comes into contact with the local narrowing of diameter of the female contact element in the corresponding cavity, before the portion of smaller diameter of the male contact element comes into contact with the contact piece housed at the bottom of the cavity.

8 Claims, 2 Drawing Sheets

U.S. PATENT DOCUMENTS

| | | | | |
|---|---|---|---|---|
| 7,950,962 | B2 * | 5/2011 | Mase et al. | 439/587 |
| 8,096,829 | B2 * | 1/2012 | Malloy et al. | 439/578 |
| 8,192,212 | B2 * | 6/2012 | Casses et al. | 439/181 |
| 2003/0008542 | A1 | 1/2003 | Schoepf et al. | |
| 2003/0077950 | A1 | 4/2003 | Swearingen et al. | |
| 2003/0216085 | A1 * | 11/2003 | Maeda | 439/852 |
| 2009/0197482 | A1 * | 8/2009 | Mark et al. | 439/852 |

OTHER PUBLICATIONS

GB search report dated Sep. 9, 2011, from corresponding GB application.

* cited by examiner

-1-

CONNECTOR ASSEMBLY FOR CONNECTION UNDER VOLTAGE

BACKGROUND OF THE INVENTION

The invention pertains to a connector assembly for making connections under voltage or "with power on". More specifically, the invention pertains to a connector assembly of this kind enabling repeated connections and/or disconnections under voltage between connection elements of said connector assembly without any risk of damaging the contact surfaces.

Certain applications in the field of connection systems call for the connection and/or disconnection of the connection elements when at least one of them is under voltage. In this case, the formation of an electrical arc is observed almost systematically between the complementary contacts, just before the electrical connection or just after the disconnection. The ionization that causes the electrical arc prompts a transfer of matter in the form of metal ions from one contact to the other. This transfer causes damage to the surfaces of the contacts and a deterioration of the electrical performance of the associated connector. The electrical resistance is then seen to increase until the electrical link is removed.

It is an aim of the invention to provide a connector assembly to set up connections under high voltage which, although they undergo the formation of electrical arcs at the time of the connection and/or disconnection, do not suffer any deterioration of electrical performance.

To this end, the invention proposes to shift the formation of the electrical arc to a non-functional part of the contacts, situated upstream to the functional part of said contacts. Thus, at the time of the connection, the electrical arc gets formed between the respective non-functional parts of the two complementary contacts, when the actual connection between the respective functional contacts of said contacts has not yet taken place. It is only when the non-functional parts of the two complementary contacts have been put into contact and therefore only when the electrical arc has disappeared that the functional parts of said contacts come into contact enabling the actual powering-on of the connector assembly. Conversely, during disconnection, there is initially a physical separation of the functional parts of said contacts while the non-functional parts for their part are still in contact. Then, the non-functional parts are away from each other. An electrical arc is then created again between these two non-functional parts. Thus, although the connector assembly of the invention cannot eliminate the formation of electrical arcs at the link between the complementary contacts of the connector assembly, it makes it possible to shift the phenomenon and the related physical deterioration to a part of the contacts not needed for the actual connection.

SUMMARY OF THE INVENTION

An object of the invention is therefore a connector assembly for connection under voltage, comprising a first connection element provided with at least one male contact protruding out of a connection face of said first connection element and a second connection element provided with at least one female contact element housed in a cavity opening out on to a connection face of said second connection element so that said male contact element can be inserted into said cavity and come into contact with the corresponding female contact, characterized in that:

at least one male contact element has one portion of greater diameter and one portion of smaller diameter, both protruding out of the connection face of the first connection element, the portion of greater diameter being upstream to the portion of smaller diameter, at least one female contact element has a local narrowing of diameter upstream to a contact piece housed at the bottom of the cavity, said local narrowing of diameter having a size smaller than or equal to the diameter of the portion of greater diameter of the male contact element, and a size strictly greater than the diameter of the portion of smaller diameter of the male contact element, so that, during a connection between the two connection elements, the portion of greater diameter of the male contact element comes into contact with the local narrowing of diameter of the female contact element in the corresponding cavity before the portion of smaller diameter of the male contact element comes into contact with the contact piece housed at the bottom of said cavity so that no electrical arc can be created between the portion of smaller diameter of the male contact element and the contact piece housed at the bottom of the cavity.

A connection face of a connection element of the connector according to the invention, is understood to mean the face pointed toward the complementary connection element to make the electrical connection.

The term "upstream" and "downstream" are understood with reference to the direction of the connection, the upstream part coming into contact with the downstream part during a connection.

The local narrowing of diameter of the female contact element is understood to be a portion of the female contact element enabling the localized reduction of the diameter of the passage for the male contact element to pass into the corresponding cavity so that the diameter of the passage at this narrowing is strictly smaller than the diameter of said passage upstream to and downstream from said narrowing.

Thus, when the male contact element is inserted into the cavity comprising the female contact element, it goes through the zone of smaller diameter before reaching the contact piece at the bottom of said cavity.

Since the portion of smaller diameter of the male contact element has a diameter smaller than the diameter of the narrowing of the female contact element, it does not come into contact with it at the time of insertion and the distance between the two at the time of the insertion is not enough to enable the creation of an electrical arc.

Then, the portion of greater diameter of the male contact element crosses the local narrowing of diameter of the female contact element, the portion of smaller diameter of the male contact element being still at a distance from the contact piece of the female contact element sufficient to prevent any formation of an electrical arc between these two elements.

Once the distance between the local narrowing of diameter of the female contact element and the portion of greater diameter of the male contact element is sufficient, an electrical arc may be formed.

Then, the portion of greater diameter of the male contact element comes into contact with the female contact element at this narrowing.

Then, the portion of smaller diameter of the male contact element comes into contact with the contact piece of the female contact element at the bottom of the cavity, the portion of greater diameter of the male contact element being still in contact with the female contact element at this narrowing.

Conversely, during the disconnection, if the electrical arc recurs, it will always be formed between the portion of greater diameter of the male contact element and the locally narrowing of diameter of the female contact element once the portion of smaller diameter of the male contact element is separated and at a sufficient distance from the contact piece of the female contact element situated at the bottom of the cavity.

According to one exemplary embodiment of the connector assembly according to the invention, it is possible to plan that at least one male contact element of the first connection element is a piston type contact, a piston of which has a portion of greater diameter upstream to a portion of smaller diameter.

Preferably, at least one female contact element has a generally cylindrical, hollow metal barrel bordering a corresponding internal wall of the cavity, upstream to a contact piece positioned at the bottom of said cavity, the metal barrel being in physical contact with said contact piece and comprising at least one flexible fin projecting into the interior of the corresponding cavity so as to form the local narrowing of diameter.

In this case, the flexible fin or fins can be cut out of the thickness of the wall of the metal barrel and can be slightly folded into the interior of said barrel so as to come into contact with the male contact element upon the insertion of this male contact element.

It is also possible to plan that at least one female contact element will comprise a generally cylindrical hollow metal barrel bordering an internal wall of the corresponding cavity upstream from a contact piece positioned at the bottom of said cavity, the metal barrel being in physical contact with said contact piece and comprising at least one protrusion projecting into the interior of the cavity so as to form the local narrowing of diameter.

BRIEF DESCRIPTION OF THE DRAWINGS

The invention will be understood more clearly from the following description and from the accompanying figures. These figures are given by way of information and in no way restrict the scope of the invention. Of these figures.

DETAILED DESCRIPTION

Figure 1:
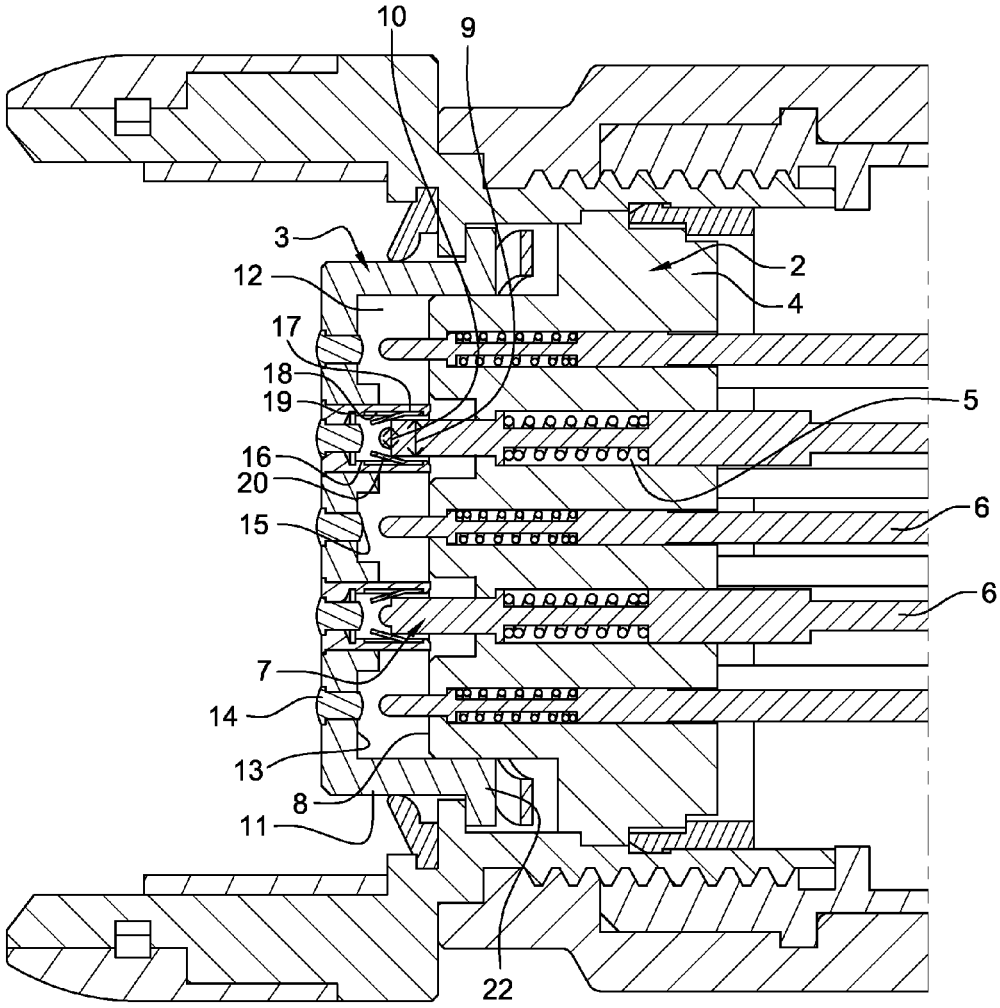
FIG. 1 is a cross-section view of a connector assembly according to one exemplary embodiment of the invention.
Figure 2A:
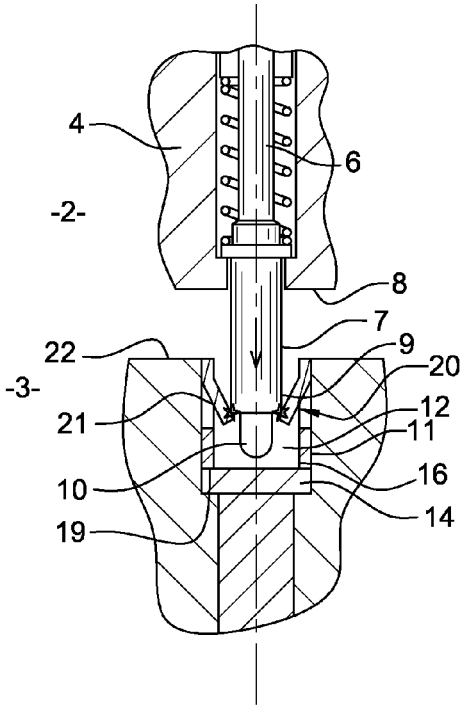
FIGS. 2 A to 2C give a schematic view of a male contact element and a female contact element of a connector assembly according to the invention, in the course of being connected (FIG. 2A), already connected (FIG. 2B) and in the course of being disconnected (FIG. 2C).
Figure 2B:
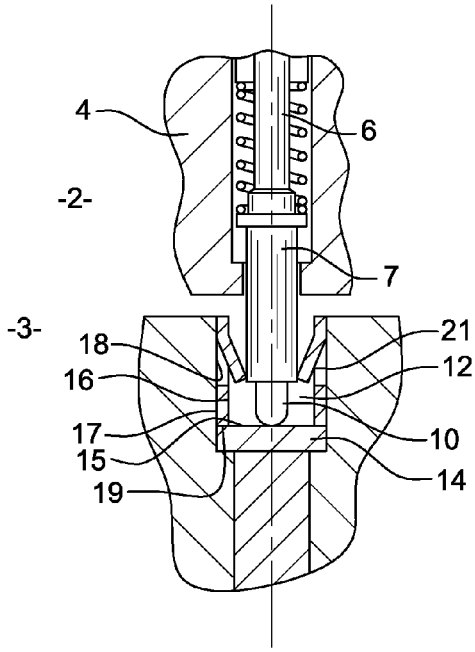
Figure 2C:
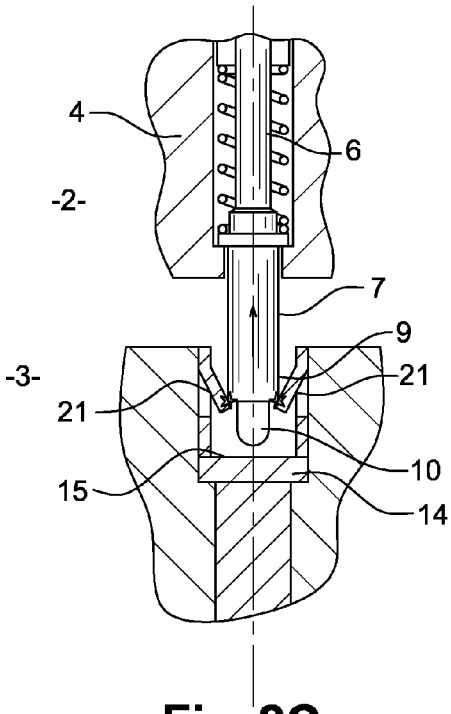

FIG. 1 is a view in cross-section of a connector assembly 1 comprising a male connection element 2 and a female connection element 3. FIGS. 2A, 2B and 2C are a magnified view of a connector assembly according to the invention which may be the connector assembly of FIG. 1, at the level of a male contact element facing a complementary female contact element.

The male connection element 2 has an insulator 4 provided with a plurality of longitudinal via channels 5 extending in parallel to the longitudinal axis of the male connection element 2. A piston type contact 6 is housed in each channel 5.

Certain of these piston type contacts 6 have a dual connection zone in compliance with the invention (two zones can be seen in FIG. 1). More specifically, a piston 7 of a piston type contact 6 with a dual connection zone opens out of the corresponding channel 5 at the level of a connection face 8 of the male connection element 2 so as to be projecting out of the insulator 4. They could of course also be pin contacts, the pins of which have a dual connection zone projecting from the connection face 8.

The dual connection zone of the male contact element 6 according to the invention is formed by a portion of greater diameter 9 and a portion of smaller diameter 10. The portion of greater diameter 9 is located upstream to the portion of smaller diameter 10. The portion of smaller diameter 10 therefore forms the connection end.

The female connection element 3 has an insulator 11 provided with a plurality of longitudinal cavities 12 extending in parallel to the longitudinal axis of the female connection element 3. Each cavity 12 opens out onto a connection face 23 facing the connection face 8 of the complementary male connection element 2. The bottom 13 of each cavity 12 has a contact piece 14 designed to cooperate electrically with the connection end 10 of a male contact element 6 of the male connection element 2. Thus, a connection end 15 of each connection piece 4 is flush with the surface of the bottom 13 of the corresponding cavity 12.

Certain cavities 12 have a dual connection zone according to the invention (two are seen in FIG. 1 facing two piston type contacts 6 also having a dual connection zone).

More specifically, in addition to a contact piece 14, each of these cavities 12 has a cylindrical, hollow barrel 16 made of conductive material, the external surface 17 of which borders the internal wall 18 of the cavity 12. A front end 9 of the cylindrical barrel 16 facing the bottom of the cavity 12 is in contact with the contact piece 14 flush with the surface. The cylindrical barrel 16 has a narrowing of diameter 20 at mid-height, represented here by a cut-out portion folded towards the interior of the cylindrical barrel 16.

FIGS. 2A to 2C give a more precise view of the tongues 21 cut out in the wall of the cylindrical barrel 16 and folded inwards.

As shown schematically in FIGS. 2A, 2B and 2C, this dual connection zone, which is present on the male contact element 6 and on the female contact element 14, 16, makes it possible to shift the formation of the electrical arc that could be created during connection on a non-functional zone of said male and female contact elements.

More specifically, for the connection (FIG. 2A), the piston 7 of the piston type contact 6 is inserted into a cavity 12, the internal wall 18 of which is bordered by the cylindrical barrel 16. The portion with the greater diameter 10 of the piston 7 goes through the narrowing of diameter 20 towards the contact piece 14.

The piston 7 continues to be pushed into the cavity 12 until the portion of greater diameter 9 of the piston 7 arrives at the narrowing of diameter 20 and more specifically the free ends of the fins 21. When the distance between the portion of greater diameter 9 of the piston 7 and the ends of the fins 21 of the cylindrical barrel 16 is sufficient, an electrical arc is created (FIG. 2A). The deterioration of the contact surface of said male and female contact elements thus takes the place in a non-functional zone of said contact elements.

The piston 7 continues to be plunged into the cavity 12 so that the portion of greater diameter 9 of said piston 7 comes into contact with the ends of the fins 21.

Then, the connection end 10 of said piston 7 comes in its turn into contact with the connection end 15 of the contact piece 14 without any electrical arc being formed beforehand in this contact zone (FIG. 2B).

At the time of this connection, the piston 7 is withdrawn from the cavity so that the connection end 10 of the piston 7 of the piston type contact 6 starts moving away from the connection end 15 of the contact piece 14. Since the portion of greater diameter 9 of the piston 7 is still in contact with the fins 21 of the cylindrical barrel 16 at the narrowing of diameter 20, no electrical arc is formed between the male contact end 10 and female contact end 15 at the time of withdrawal (FIG. 2C).

Then, the withdrawal is continued until the portion of greater diameter 9 of the piston 7 is physically separated from the fins 21. So long as the distance between said portion of greater diameter 9 and said fins 21 is sufficient, an electrical arc is seen between them. The electrical arc disappears when the distance between said portion of greater diameter 9 and said fins 21 is too great.

It is thus possible, at will, to repeat the connection and disconnection operations between the piston type contacts 6 of the male connection element 2 and the female contacts 14, 16 of the complementary female connection element 3 without damaging the functional connection zone 10, 15 of either the male contact element 6 or the female contact element 14 of the invention when either or both of these connection elements is or are powered on during these connection/disconnection operations.

The invention claimed is:

1. A connector assembly for connection under voltage, comprising:

a first connection element provided with at least one male contact protruding out of a connection face of said first connection element;

and a second connection element provided with at least one female contact element housed in a cavity opening out on to a connection face of said second connection element so that said male contact element can be inserted into said cavity and come into contact with the corresponding female contact, wherein:

at least one male contact element has one portion of greater diameter and one portion of smaller diameter, both protruding out of the connection face of the first connection element, the portion of greater diameter being upstream to the portion of smaller diameter, at least one female contact element has a contact piece housed at the bottom of the cavity and a local narrowing of diameter, upstream of the contact piece housed at the bottom of the cavity, said local narrowing of diameter having a size smaller than or equal to the diameter of the portion of greater diameter of the male contact element, and a size strictly greater than the diameter of the portion of smaller diameter of the male contact element, so that, during a connection between the two connection elements, the portion of greater diameter of the male contact element comes into contact with the local narrowing of diameter of the female contact element in the corresponding cavity before the portion of smaller diameter of the male contact element comes into contact with the contact piece housed at the bottom of said cavity wherein, when an electrical arc is created, the electrical arc is created in a non-functional zone of the local narrowing of diameter of the female contact element and the portion of greater diameter of the male contact element.

2. The connector assembly according to claim 1, characterized in that at least at least one male contact element of the first connection element is a piston type contact, a piston of which has a portion of greater diameter upstream to a portion of smaller diameter.

3. The connector assembly according to claim 1, characterized in that at least at least one female contact element has a generally cylindrical, hollow metal barrel bordering a corresponding internal wall of the cavity, upstream to a contact piece positioned at the bottom of said cavity, the metal barrel being in physical contact with said contact piece and comprising at least one protrusion projecting into the interior of the cavity so as to form the local narrowing of diameter.

4. The connector assembly according to claim 1, characterized in that at least one female contact element has a generally cylindrical, hollow metal barrel bordering a corresponding internal wall of the cavity, upstream to a contact piece positioned at the bottom of said cavity, the metal barrel being in physical contact with said contact piece and comprising at least one flexible fin, projecting into the interior of the corresponding cavity, so as to form the local narrowing of diameter.

5. The connector assembly according to claim 4, characterized in that at least one flexible fin is made in the thickness of the wall of the metal barrel of the female contact element.

6. The connector assembly according to claim 2, characterized in that at least at least one female contact element has a generally cylindrical, hollow metal barrel bordering a corresponding internal wall of the cavity, upstream to a contact piece positioned at the bottom of said cavity, the metal barrel being in physical contact with said contact piece and comprising at least one protrusion projecting into the interior of the cavity so as to form the local narrowing of diameter.

7. The connector assembly according to claim 2, characterized in that at least one female contact element has a generally cylindrical, hollow metal barrel bordering a corresponding internal wall of the cavity, upstream to a contact piece positioned at the bottom of said cavity, the metal barrel being in physical contact with said contact piece and comprising at least one flexible fin, projecting into the interior of the corresponding cavity, so as to form the local narrowing of diameter.

8. The connector assembly according to claim 3, characterized in that at least one female contact element has a generally cylindrical, hollow metal barrel bordering a corresponding internal wall of the cavity, upstream to a contact piece positioned at the bottom of said cavity, the metal barrel being in physical contact with said contact piece and comprising at least one flexible fin, projecting into the interior of the corresponding cavity, so as to form the local narrowing of diameter.

* * * * *